US006471773B1

(12) United States Patent
Atkins

(10) Patent No.: US 6,471,773 B1
(45) Date of Patent: Oct. 29, 2002

(54) DOCTOR BLADE ASSEMBLY

(75) Inventor: Mark R. Atkins, 22W236 First St., Glen Ellyn, IL (US) 60137

(73) Assignee: Mark R. Atkins, St. Charles, IL (US)

( * ) Notice: Subject to any disclaimer, the term of this patent is extended or adjusted under 35 U.S.C. 154(b) by 80 days.

(21) Appl. No.: 09/594,968

(22) Filed: Jun. 15, 2000

Related U.S. Application Data

(60) Provisional application No. 60/142,472, filed on Jul. 6, 1999.

(51) Int. Cl.[7] ..... B05C 11/04

(52) U.S. Cl. ..... 118/123; 118/126; 118/203; 118/261; 118/413; 101/350.6; 15/256.5; 15/256.51

(58) Field of Search ..... 118/123, 126, 118/203, 261, 413; 101/350.6, 363, 364, 365, 366; 15/256.5, 256.51; 427/356

(56) References Cited

U.S. PATENT DOCUMENTS 4,009,657 A * 3/1977 Bonanno et al. ..... 101/366
4,488,483 A * 12/1984 Kohara ..... 101/350.6
4,497,250 A * 2/1985 Dressler ..... 101/366
5,791,248 A 8/1998 Atkins et al. ..... 101/350.6
6,029,573 A * 2/2000 Capdeboscq ..... 101/350.6
6,095,045 A * 8/2000 Petersen et al. ..... 101/350.6
6,119,595 A * 9/2000 Garris et al. ..... 101/366

* cited by examiner

*Primary Examiner*—Laura Edwards

(57) ABSTRACT

"Ghosting" and leakage problems in a doctor blade assembly are minimized or eliminated in a construction that includes a reservoir (10) partially surrounding a transfer roller (12) wherein a surface of the roller (12) is within the reservoir (10) for at least 180° of its rotation. The reservoir (10) is desirably split into two segments (50), (52) which are mounted for relative movement so as to allow access to the interior of the reservoir (10) as well as to the roll (12). Chambered end plates (82), (84) house seals (10) and receive parts (144) of the ends of doctor blades (40), (42) which extend past the end (142) of the roll (112) to promote good sealing at the ends of the assembly.

8 Claims, 5 Drawing Sheets

32

DOCTOR BLADE ASSEMBLY

CROSS REFERENCE

This application is based on Provisional Patent Application Ser. No. 60/142,472, filed Jul. 6, 1999.

FIELD OF THE INVENTION

This invention relates to doctor blade assemblies used for metering a liquid such as an ink or a coating material onto the surface of a rotating transfer roller.

BACKGROUND OF THE INVENTION

Doctor blade assemblies are commonly employed to meter a liquid, such as an ink or a coating material, onto a transfer roller for ultimate disposition on the surface of a flexible substrate that is to be printed upon or coated. Conventionally, a doctor blade assembly includes a small, elongated reservoir of a length at least equal to that of the transfer roll. An elongated opening extends the length of the reservoir and on opposite sides of the opening, doctor blades are located. The liquid to be transferred to the transfer roll is placed in the reservoir and the transfer roller is rotated in engagement with the doctor blades. Its surface receives the liquid to be transferred from the interior of the reservoir. As the wetted surface of the roller passes the first doctor blade, the same causes the film of liquid on the surface to be made uniform for ultimate transfer to a substrate. As the roller continues to rotate, the second doctor blade is encountered as the roller surface is about to reenter the reservoir. This doctor blade is frequently called a containment blade and allows ink or other liquid remaining on the roller to reenter the reservoir while preventing the liquid in the reservoir from splashing outwardly thereof.

In conventional doctor blade assemblies, the two doctor blades are separated by 90° or less when measured angularly within the reservoir. Moreover, both oft he doctor blades engage the surface of the roller with approximately the same contact pressure which can cause the liquid being transferred to puddle on the side of the containment blade that is exterior of the reservoir and cause leakage problems.

Leakage of the liquid being coated on the transfer roll is also particularly vexatious in that periodic clean up is required and adds to the cost of the operation employing the doctor blade assembly.

The leakage problem in conventional doctor blade assemblies is accentuated by the fact that in such conventional assemblies, seals at the ends of the rolls engage the cylindrical surface of the roll, in an attempt to prevent all flow of ink to the sides of the roller. Friction thereat generates heat which tends to dry the ink which congeals on the seal and fouls the same, thereby disabling the seal with the consequence that leakage increases with the use of a particular set of seals necessitating frequent replacement of the seals if the leakage is to be avoided.

So-called "ghosting" is a common problem with the use of conventional doctor blade assemblies and printing applications which is highly undesirable.

The present invention is directed to overcoming one or more of the above problems.

SUMMARY OF THE INVENTION

It is the principal object of the invention to provide a new and improved chambered, doctor blade assembly. More specifically, it is an object of the invention to provide such a doctor blade assembly wherein "ghosting" problems are minimized or eliminated and/or leakage from liquid contained within the chamber is minimized.

An exemplary embodiment of the invention achieves the foregoing object in a structure including a generally cylindrical roll mounted for rotation about an axis and adapted to engage another roll. A chamber is provided which partially surrounds the roll and is generally C-shaped in cross section to define an opening extending parallel to the roll axis through which the roll is accessible to engage another roll. A pair of blades are mounted on the chamber near respective sides of the opening and have edges extending into the chamber and parallel to the axis and engaging the roll.

According to one aspect of the invention, the chamber is in two segments with the segments being mounted for movement relative to each other so that at least one of the segments may move toward or away from the axis of the roll.

According to another aspect of the invention, the edges of the blades are angularly spaced from one another by about at least 180° as measured in the chamber.

According to still another aspect of the invention, the roll has a blade engaging surface and the doctor blade edges have a length just greater than the length of the blade engaging surface and extend just past opposite ends of the blade engaging surface.

In a preferred embodiment, foam seals are located at opposite ends of the roll and the doctor blades have ends partially entering the foam seals.

According to still another aspect of the invention, one of the doctor blades is upstream of the other doctor blade in the direction of rotation of the roll and engages the roll with about twice the contact pressure or more than that of the other doctor blade.

According to still another aspect of the invention, the chamber is generally partially cylindrical with a cylindrical axis. The cylindrical axis is parallel to, but offset from, the axis of the roll so that the roll is closer to an interior wall of the chamber at a location generally oppositely of the opening than elsewhere within the chamber.

In still another exemplary embodiment of the invention, the interior wall of the chamber has axially extending grooves.

Other objects and advantages will become apparent from the following specification taken in connection with the accompanying drawings.

DESCRIPTION OF THE PREFERRED EMBODIMENT

Figure 1:
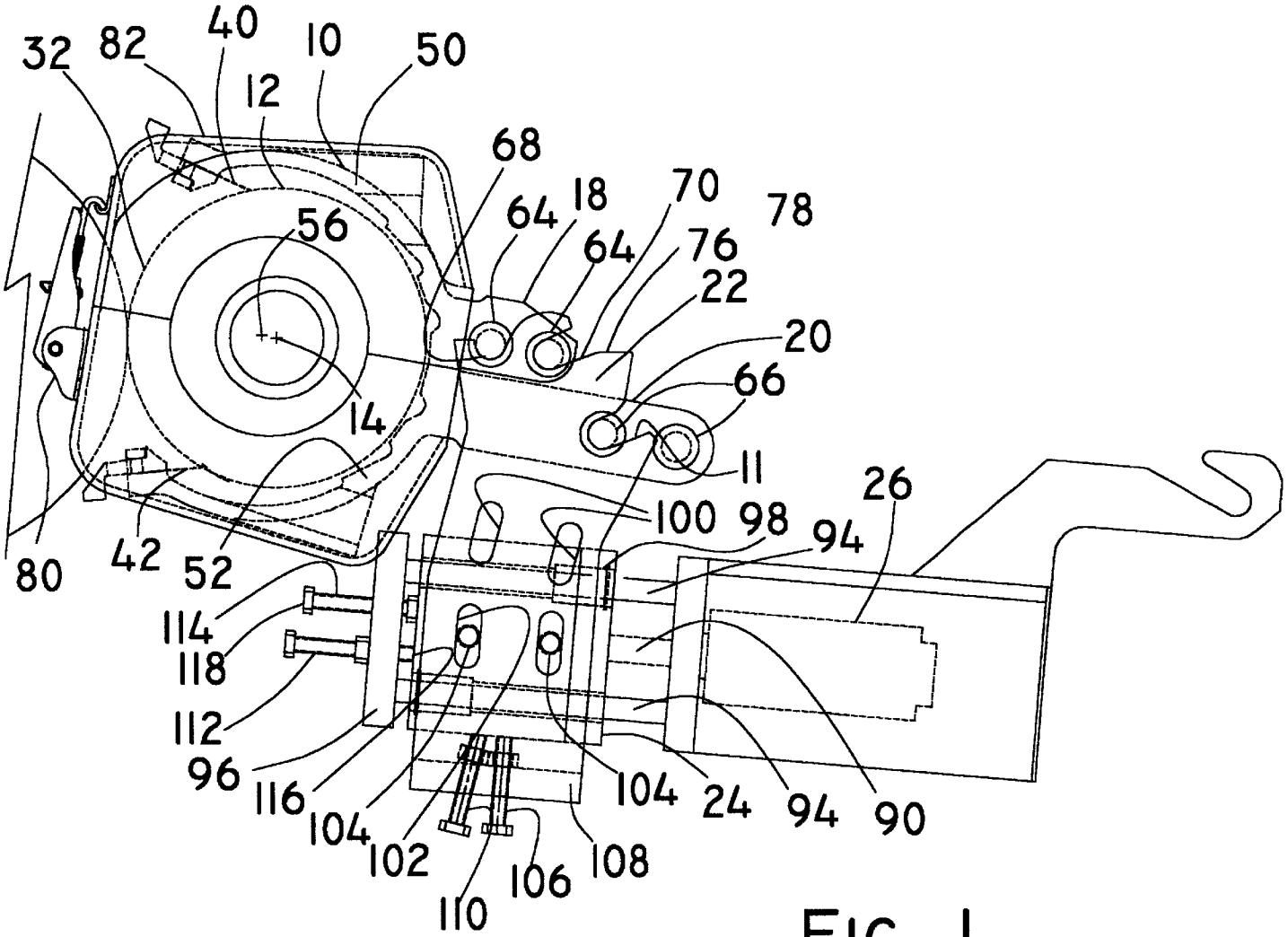
FIG. 1 is a sectional view of a chambered doctor blade assembly made according to the invention.

An exemplary embodiment of a chambered doctor blade assembly made according to the invention is illustrated in FIG. 1. It will be described in connection with a printing operation wherein the fluid employed is in ink. However, it is to be understood that other liquids could be utilized in non-printing operations. For example, the doctor blade assembly of the invention could be employed to place a coating on a flexible substrate as, for example, a protective coating. Thus, no limitation to use in a printing operation is intended except insofar as expressly stated in the appended claims.

The assembly includes a fluid reservoir, generally designated 10, in which a transfer roll, generally designated 12, is mounted for rotation about an axis 14. The roll 12 is mounted, at its opposite ends, for rotation about the axis 14 by bearings 16 (FIG. 4) which in turn may be mounted by any suitable means to a frame for a printer or the like.

Returning to FIG. 1, support arms, generally designated 18 and 20, are connected to the reservoir 10 to mount the reservoir on two, spaced claw plates, each designated 22 (only one of which is shown) at opposite ends of the roll 12. Each claw plate 22 is, in turn, mounted on a slide, generally designated 24, which may be moved generally from left to right and vice versa by means of an air cylinder, generally designated 26.

Figure 2:
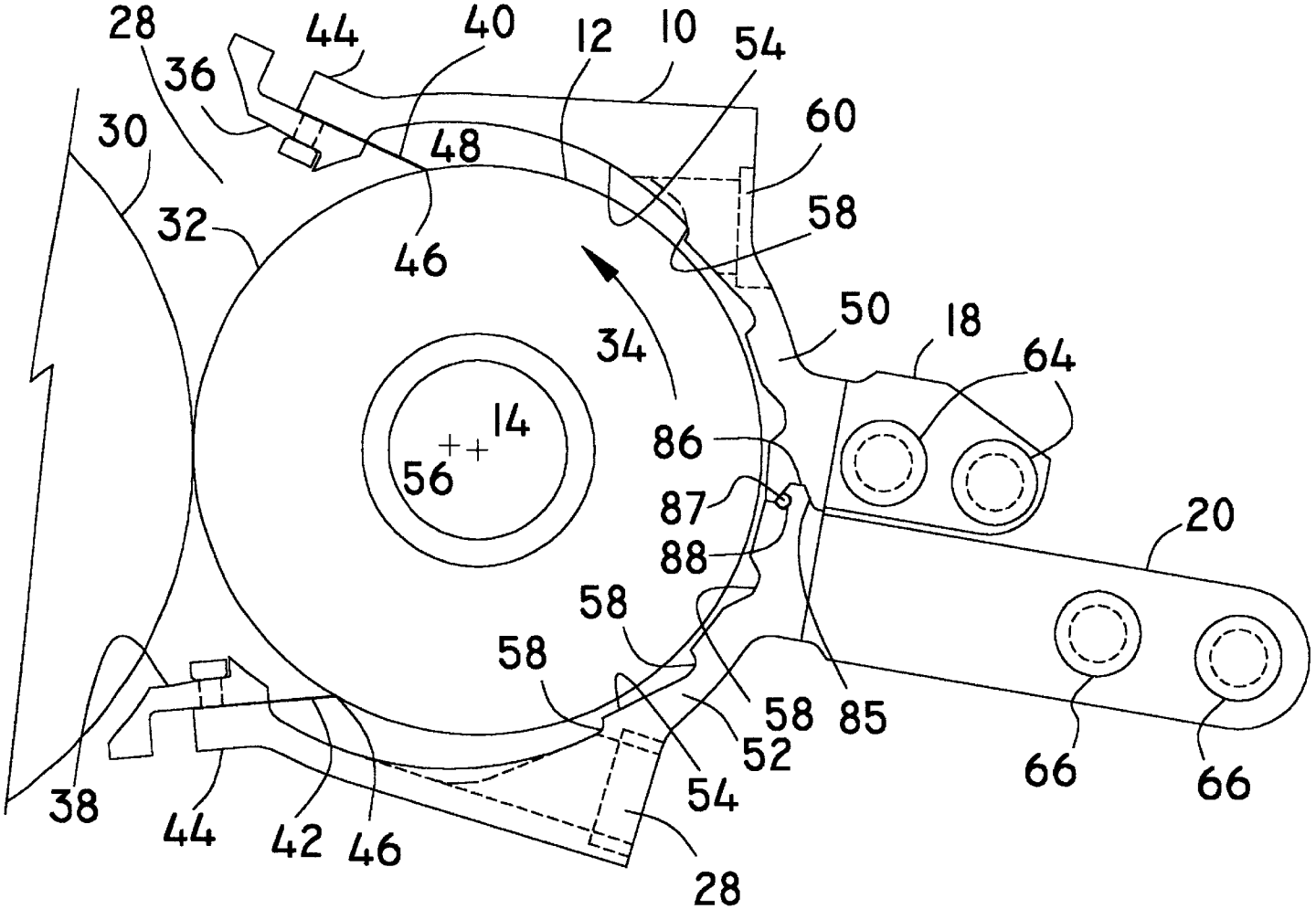
FIG. 2 is an enlarged, fragmentary vertical section of part of the assembly with end caps removed for clarity.

As perhaps best seen in FIG. 2, the reservoir 10 has an opening 28 on one side thereof which extends the length of the roller 12 so as to provide an access opening whereby the roller 12 may be brought into engagement with a printing roll 30 to transfer ink thereto.

The roll 12 includes a transfer surface 32 of conventional design. That is to say, the same includes microscopic pockets, typically in a honeycomb pattern, in which ink is received as the roll 12 rotates in the direction of an arrow 34 within the reservoir 10. Near the sides 36 and 38 of the opening 28, the reservoir 10 mounts inwardly directed doctor blades 40 and 42, respectively. The blades 40 and 42 are held in place by any suitable clamping structure, generally designated 44, at the associated side 36,38 of the reservoir opening 28. For the direction of rotation shown by the arrow 34, the blade 42 serves as a doctor blade for metering the liquid applied to the surface 32 while the blade 40 serves as a conventional containment blade. To this end, both have edges 46 which are parallel to the axis 14 and which engage the cylindrical surface 32 of the roller 12. The edges 46 are angular spaced at least 180°, and preferably, at least 220° from each other as measured within the reservoir 10. This promotes longer contact of the surface 32 within the reservoir 10, and thus better inking of the surface 32.

Continuing with the description of FIG. 2, the reservoir defines a chamber 48 within which the roll 12 rotates as mentioned previously. The reservoir is made up of two segments including an upper segment 50 as shown in FIG. 2 and a lower segment 52 as shown in FIG. 2. Each of the segments 50 and 52 includes an interior wall 54 which is generally partially cylindrical and of a larger diameter than the roll 12 as illustrated and which includes a cylindrical axis 56. It will be noted that the cylindrical axis 56 of the interior wall 54 is offset in the direction of the opening 28 from the cylindrical axis 14 about which the roller 12 rotates. As a consequence, that part of the surface 32 within the chamber 48 and generally oppositely of the opening 28 is much closer to the interior wall 54 than elsewhere. For the direction of rotation shown by the arrow 34, this means that as one moves from the doctor blade 40 in the direction of rotation 34, the distance between the surface 32 and the interior wall 54 progressively diminishes which promotes filling of the microscopic pockets in the surface 32 of the roll. This assures that the surface 32 is properly inked to eliminate or minimize ghosting. It should be appreciated that the degree of offset will diminish with a particular set of blades when the apparatus is periodically adjusted to compensate for blade wear. To further enhance this action, the interior wall 54 is provided with a series of axially extending grooves 58. As the roll 12 rotates within the chamber 48, a pattern of turbulence is set up by the grooves 58 to further promote proper inking of the surface 32.

The upper segment 50 also includes, along its length, one port 60 which, for the direction of rotation shown by the arrow 34 may serve as an outlet port to the interior of the chamber 48. Similarly, the lower segment 52 includes one port 62 which may serve as an inlet port.

There are two of the support arms 18, one at each end of the upper segment 50 which are secured by any suitable means to the upper segment 50. The same receives spaced bolts 64 by which the upper segment 50 may be mounted to the claw plate 22. The support arm 20 for the lower segment 52 is of somewhat greater length than the support arm 18 but likewise mounts two bolts 66 for mounting purposes. The belts 64 and 66 are used to align the segments 50, 52 axially of the roller and one each of the bolts 64, 66 also serves as a pivot for purposes to be seen. Again, there are two of the support arms, one at each end of the reservoir.

As seen in FIG. 2, the upper segment 50 includes a wedge shaped groove 85 which receives a complimentary wedge shaped ridge 86 on the lower segment 52 for properly orienting the segments 50, 52 with respect to each other. A seal 87 is located in a groove 88 in the ridge 86 to seal the interface of the segments 50, 52. Similarly locating recesses/ridges and/or seals (not shown) are located at the interface of the end plate segments 82, 84.

Returning now to FIG. 1, the claw plate 22, near its upper extremity, is seen to include three notches 68, 70 and 72. The notch 68 opens generally upwardly 5 whereas the notches 70 and 72 open generally to the side and slightly upwardly. The notches 68 and 70 receive the bolts 64 as illustrated in FIG. 1. The notch 70 is provided with a conventional spring loaded detent 74 which bears against the right-hand most one of the bolts 64.

Additionally, just to the right of the notch 70 is a generally flat surface 76 for purposes to be seen.

The notch 72 receives the left-hand most one of the bolts 66 to support the lower segment 52.

Conventional toggle clamps, generally designated 78, are located at several locations along the length of the reservoir 10 and are used to clamp the upper 15 and lower segments 50, 52 together in the vicinity of the mounting arms 18, 20. Two similar clamps 80 are mounted on end plate segments 82, 84 on opposite sides of the opening 28 to clamp the left-hand ends of the segments 50, 52 together in assembled relation as shown in FIG. 1.

Figure 3:
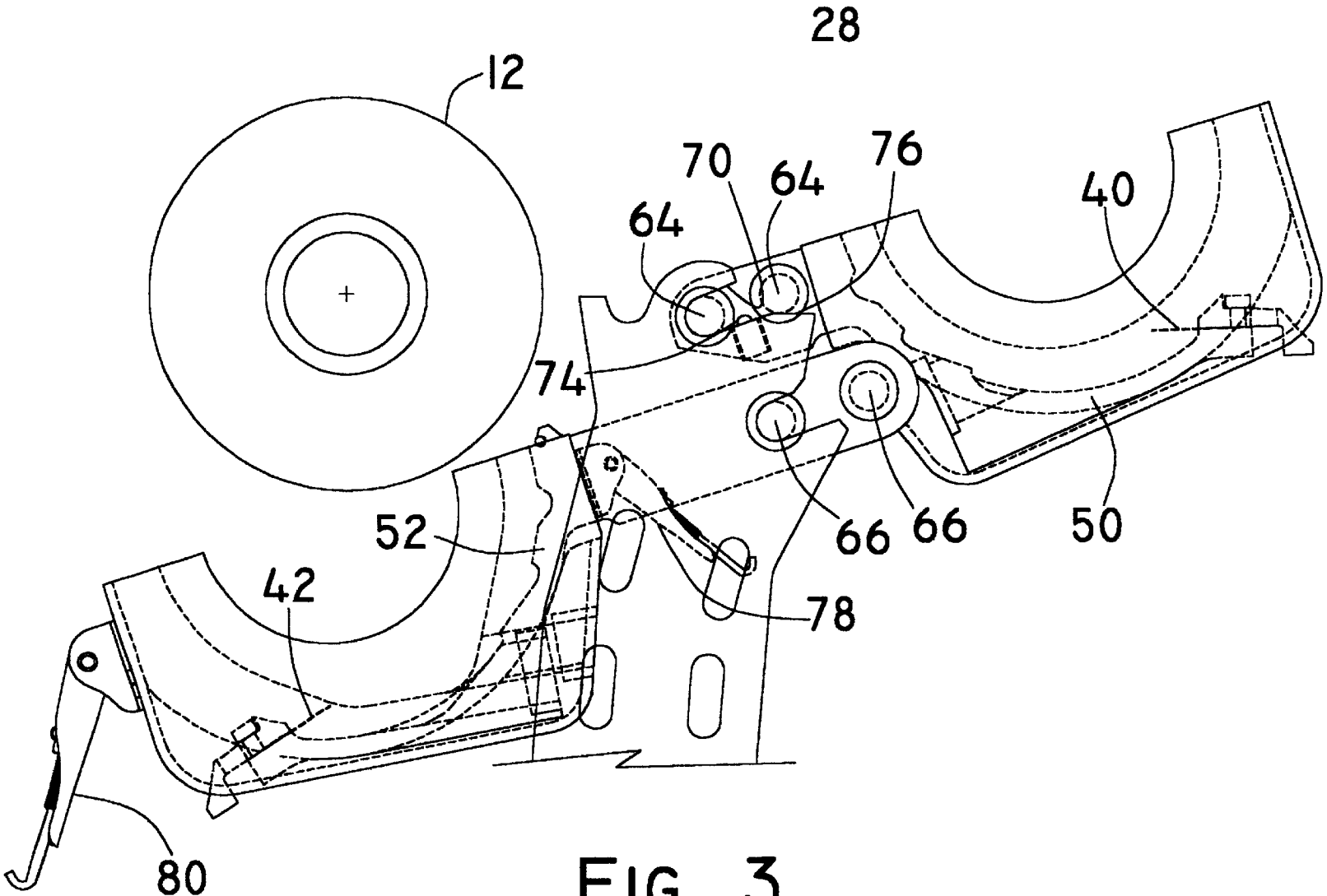
FIG. 3 is a vertical section of the doctor blade assembly with a chamber opened to expose the roll.

To achieve access to the roller 12 for servicing or to achieve access to the interior of the reservoir 10 for any other purpose as, for example, changing or adjusting the doctor blades 40, 42, the reservoir 10 may be opened by releasing the clamps 78 and 80 and opening the segments 50 and 52 in a clam shell like fashion as best shown in FIG. 3. The upper segment 50 may be pivoted about the right most bolt 64 to approximately the position illustrated in FIG. 3. At this point, the other bolt 64 will encounter the flat surface 76 to prevent further rotation of the upper segment 50 from the position shown in FIG. 3. In this connection, the detent 74 acts to ensure that the bolt 64 within the recess 70 will not inadvertently exit the same so that the upper segment 50 is supported in the position as shown. Of course, if it is necessary to completely remove the segment 50 from the assembly, it need only be pulled to the right as illustrated in FIG. 3 past the detent 74 and then removed. Releasing the toggles 80 and pivoting the upper segment 50 as mentioned above allows the lower segment 52 to drop downwardly to the position illustrated in FIG. 3.

As is well known, the doctor blade assembly, and specifically, the reservoir 10 and the doctor blades 40 and 42 are biased against the surface 32 of the roll 12 to achieve a desired contact pressure of their edges 46 against the roll 12. Conventionally, this is accomplished by adjusting screws, or in some cases, by a pair of air cylinders, one at each end of the assembly. One such air cylinder is shown at 26 in FIG. 1 and is mounted to the printer frame in any suitable fashion. The air cylinder 26 includes a piston rod 90 (FIG. 1) which is rigidly connected to a slide plate 92. Slide rods 94 extend between the cylinder 26 and a plate 96 which is also secured to the printer frame. Each slide plate 92 includes bushings 98 about the rods 94 so as to be mounted for movement to the right and to the left as viewed in FIG. 1.

Each claw plate 22 includes four elongated apertures including a set of apertures 100 and a set of apertures 102. As seen in FIG. 1, bolts 104 extend through the apertures 102. The bolts 104 may be tightened to secure the claw plate 22 to the adjacent slide plate 92 for movement therewith. For the direction of rotation of the roll 12 illustrated by the arrow 34 in FIG. 2, the bolts 104 are disposed in the apertures 102. For an opposite direction of rotation, the apertures 100 are employed.

When the piston rod 90 is moved to the right in FIG. 1, the doctor blades 40 and 42 are drawn against the surface 32 of the roll 12 to perform their containment and doctoring functions respectively. When the rod 90 is extended to the left as viewed in FIG. 1, the blades 40 and 42 are moved away and out of contact with the surface 32.

The elongation of the apertures 100 and 102 provides for vertical adjustment of the claw plate 22 on the slide plate 92. An adjusting bolt 106 on a base plate 108 on the lower end of the claw plate 22 is employed to set the relative positions of the slide plate and the claw plate 22 respectively when the apertures 102 are used. A similar adjusting bolt 110 is utilized when the apertures 100 are used.

In addition, the plate 96 also mounts adjustable stops in the form of bolts 112 and 114. The end 116 of the bolt 112 engages a side of the slide plate 92 to serve as a stop for leftward of the slide plate 92 while the head 118 of the bolt 114, by engagement with the plate 96 serves as a stop for rightward movement of the slide plate 92.

In setting up the apparatus, either the bolt 106 or the bolt 110 is utilized to set the location of the claw plate 22 relative to the slide plate 92. The bolts 104 are then tightened. In general, the arrangement will be such that through the use of a tool applied to the base 108, bring the bolt 106 into contact with the slide plate 92, the edges 46 of the blades 40 and 42 are brought into engagement with the surface 32 of the roll 12. The bolts 112 and 114 may then be adjusted to set the limits of travel of the slide plate 92.

It is to be observed that FIG. 1 is essentially to scale and it will be seen that the direction of force application to the claw plate 22 by the cylinder 26 and the slide plate 92 is to the lower side of the point of contact of the edges 46 of the blades 40 and 42 with the surface 32. This results in the contact pressure of the blade 42, for the direction of rotation 34 illustrated in FIG. 2, being approximately two times or greater than the contact pressure of the blade 40 with the surface 32. In this connection, it will be observed that the moment arm over which the force generated by the cylinder 26 is applied to the point of contact of the blade 42 with the surface 32 is considerably less than the moment arm from the point of contact of the blade 40 with the surface 32 to the direction of force location. In both cases, the moment arm is measured at right angles to the direction of force application by the cylinder 26.

Using the foregoing adjustments, conventional contact pressure of the blade 42 against the roller surface to achieve the desired doctoring function can be obtained. The geometry described above and shown in FIG. 2 will result in the blade 40 having half the contact pressure or less with the result that ink on the surface 32 after the same has contacted the print roller 30 (FIG. 2) may more readily pass under the containment blade 40 back into the reservoir to eliminate pooling of the ink at the interface of the edge 46 of the blade 40 and the surface 32, thereby minimizing leakage at that location.

When the apertures 100 are used for opposite rotation of the roll 12, the blade 40 assumes the doctoring function while the blade 42 assumes the containment function but in this case, the blade 40 will have at least twice the contact pressure as the blade 42.

Figure 4:
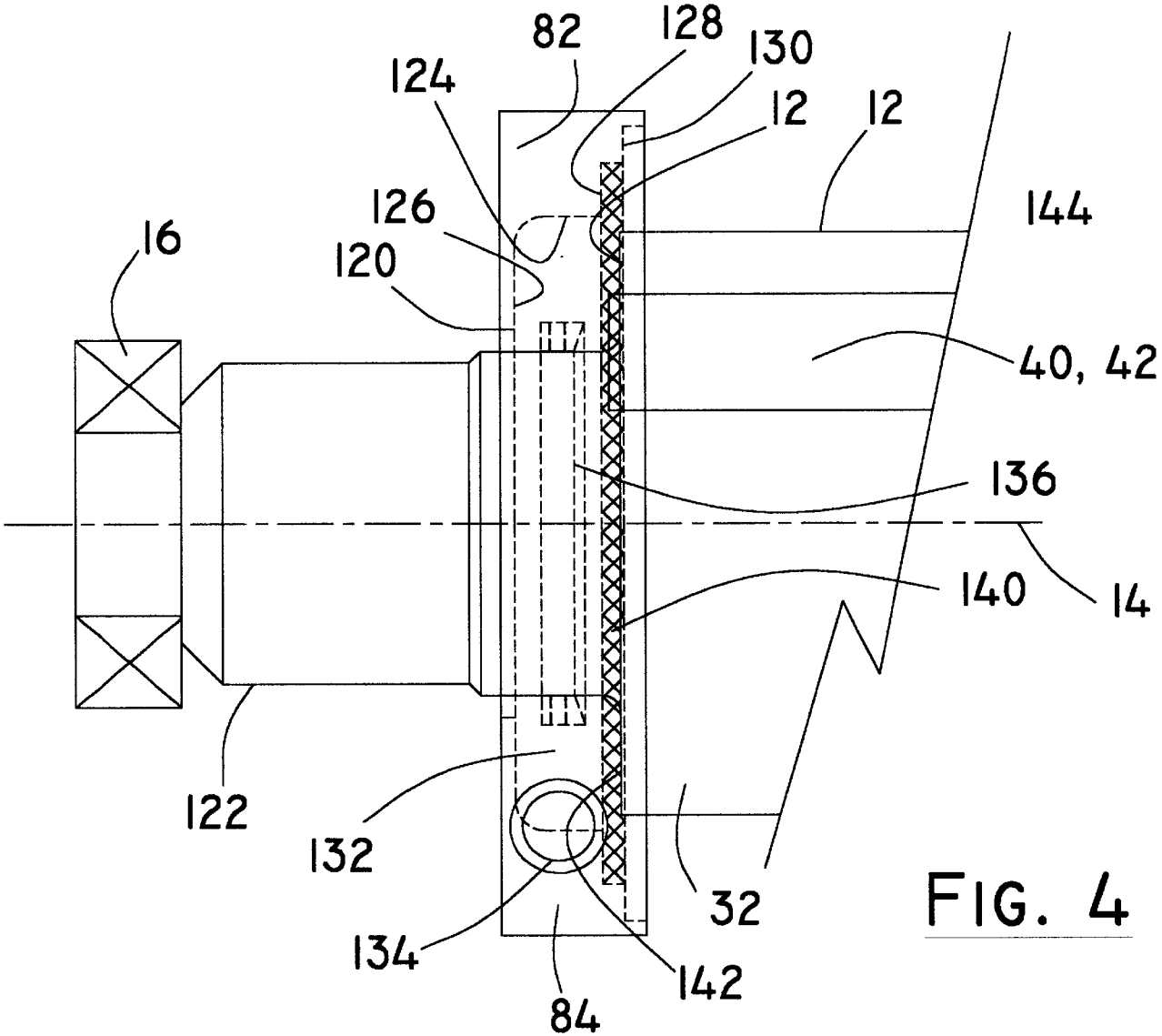
FIG. 4 is a fragmentary, sectional view of one end of the roll showing an end plate, it being understood that the opposite end of the roll is essentially a mirror image of the showing in FIG. 4.

FIG. 4 illustrates the end plates at opposite ends of the assembly which, it will be recalled, are made up of two segments 82 and 84. The respective segments 82 and 84 are respectively mounted, as by alignment pins, with the aid of the toggles 80 to the reservoir segments 50, 52 and in section, appear as illustrated in FIG. 4. It will firstly be seen that each end plate segment 82, 84, includes an opening 120 of slightly greater diameter than the shaft 122 for the roller 12. This opening is made sufficiently large so as to allow the reservoir 10 to be moved relative to the roller 12 by action of the air cylinder as mentioned earlier without bringing interfering contact between the end plate 82, 84 and the shaft 122. The opening 120 leads to a recess 124 having three steps, 126, 128 and 130. The steps 126, 128, 130 ope towar the roll 12 with the step 126 having the smallest diameter, the step 130 having the largest diameter, and the step 128 having an intermediate diameter.

The step 126 defines an ink recovery chamber 132 which in turn has a port 134 which may be connected to an ink return. The port 134 is located at the lower extremity of the lower end plate segment 84.

The shaft 22, within the step 126, includes a slinger seal 136. Ink reaching the slinger seal 136 is thrown radially outwardly by centrifugal force as the roller 12 rotates to engage the radially outer wall of the step 126 whereat it may flow downwardly within the chamber 132 to the port 134.

The step 128 receives a foam seal 140 which lightly engages the side surface 142 of the roll 12 radially outward of the step 126. Thus, the same serves as a gross seal to seal the roll 12 to the reservoir 10 on its ends, rather than on its cylindrical surface. Because of the light engagement of the seal 140 with the end of the roll 12, some ink will flow in a controlled manner to the roll/seal interface 142 to lubricate the same and thereby increase seal life. Heat buildup and drying of ink is eliminated and the seal 140 will wear at a lesser rate. To the extent that there is leakage past the seal, it is picked up eventually within the chamber 132 and moved to the exit 134 by operation of the slinger seal 136. Typically, the seal 140 will be made in two segments along the same parting line as the end plate segments 82, 84.

The ends of the reservoir segments 50, 52 loosely nest in the step 130 which serves to catch ink at the end of the roll 12.

It will be observed from FIG. 4 that the blades 40, 42 have a length slightly greater than the length of the surface 32 of the roll 12 and thus have a small section 144 that extends past the end 142 and into the foam seal 140. This feature enhances sealing at the ends of the rolls.

Figure 5:
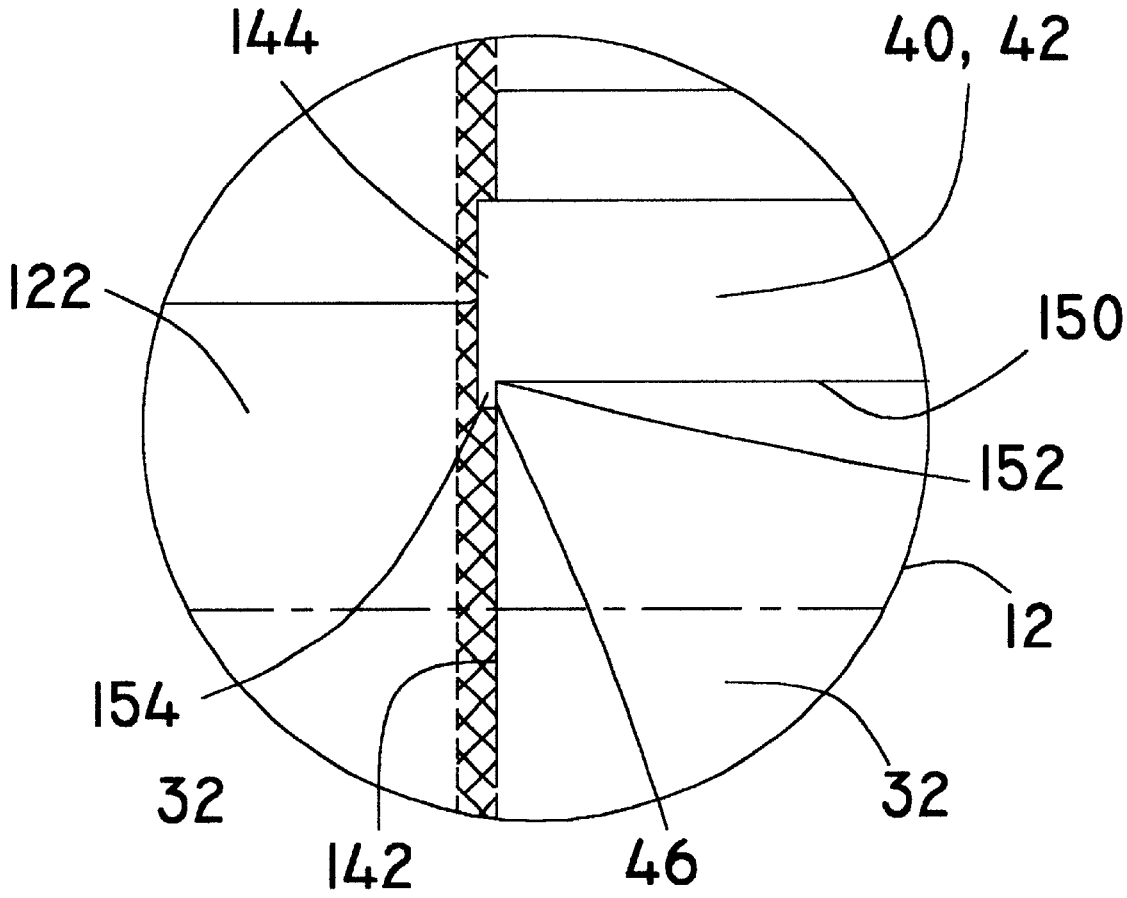
FIG. 5 is an enlarged, fragmentary view of an end of the roll and the end of a doctor blade.

Referring to FIG. 5, after the blades 40, 42 have been in use for awhile, they begin to wear as a result of their contact with the surface 32. As a consequence, a notch 150 is formed in the edge 56 and has a length equal to the length of the surface 132. A right angle junction 152 is formed with the consequence that a part 154 of the blades 40, 42 that extends past the side 142 of the roll 12 engages the side 142 of the roll 12 to form at least a gross seal thereat, further enhancing sealing at the ends of the roll 12.

In any event, to the extent that there is leakage past the part 154 of the blades 40, 42, it is to the seal 140. Thus, further minimization of leakage at the ends of the roll 12 is provided.

From the foregoing, it will be appreciated that a doctor blade assembly made according to the invention possesses numerous advantages over conventional doctor blade assemblies. The unique sealing provided by the seals 140 and the parts 152 of the doctor blades 40, 42 considerably increase seal life while containing the leakage of ink serving as the seal lubricant. The use of a lesser contact pressure at the containment blade than that applied at the doctor blade reduces puddling at the interface of the containment blade and the surface 32 of the roll 12 to further minimize leaking.

The use of a C-shaped chamber such as defined by the segments 50, 52 of the reservoir 10 allows the doctor blades 40, 42 to have a greater angular spacing within the reservoir to assure better inking of the roll surface 32. Furthermore, the offset between the rotational axis 14 of the roll 12 and the axis of the generally cylindrical interior wall 50, 54 of the reservoir 10 promotes better entry of the ink into the microscopic recesses in the surface 32 of the roll 12 as does the presence of the turbulence promoting recesses 58 in the interior wall 54. The fact that the roll surface 32 is within the reservoir 10 through at least 180° of its travel, and preferably at least 220° of travel, further promotes good inking which tends to minimize or eliminate ghosting problems experienced with conventional designs.

Optimally, all of the features described above are employed in a single assembly but those skilled in the art will readily appreciate that where lesser efficiency is all that is required, only one or two of the features may be employed and the others omitted.

I claim:

1. An enclosed chambered doctor blade assembly comprising:

a generally cylindrical roll mounted for rotation about an axis;

a chamber partially surrounding said roll and being generally C-shaped in cross section to define an opening having ends connected by spaced sides to define an opening extending parallel to said axis through which the roll is accessible to engage another roll;

a pair of blades mounted on said chamber adjacent respective ones of said sides and extending into the chamber and with edges of the blades engaging said roll at spaced locations and parallel to said axis;

said edges of said blades being angular spaced from one another by more than 180° as measured in said chamber;

an adjustment mechanism at each end of the chamber to move the enclosed chamber doctor blade assembly relative to the said roll for said blade adjustment;

a pair of end seals located respectively at each end of the chamber and are in contact with the side of the roll face and control leakage out of the ends of the chamber; and a pair of end plates that house the end seals and capture the controlled leakage from the end seals.

2. The doctor blade assembly of claim 1 wherein said roll has a blade engaging surface and said doctor blade edges have a length just greater than the length of said blade engaging surface and extend just past each of the opposite ends of said blade engaging surface.

3. The doctor blade assembly of claim 1 wherein the adjustment mechanism guides the chamber in a plane such that a proportionally greater contact pressure is put on the doctor blade that scraps the transfer roll surface as the doctor blade exits the reservoir.

4. The doctor blade assembly of claim 1 wherein said chamber is generally partially cylindrical with a cylindrical axis, the cylindrical axis being parallel to, but offset from, said roll axis so that the roll is closer to an interior wall of the chamber generally oppositely of said opening than elsewhere within the chamber.

5. The doctor blade assembly of claim 2 wherein said interior wall has axially extending grooves.

6. The doctor blade assembly of claim 1 wherein the said end seals are in contact with the end of the chamber and the side of the transfer roll face, forming a seal to the chamber and allowing controlled leakage past the seal in the area of where the end seal and the side of the roll face are in contact.

7. The doctor blade assembly of claim 1 wherein said chamber is formed of at least two segments and at least one segment is mounted on a pivot parallel to but spaced from said axis.

8. The doctor blade assembly of claim 7 wherein said segments are mounted on respective pivots parallel to but spaced from said axis.

* * * * *